US009476138B2

(12) United States Patent
Suwa et al.

(10) Patent No.: US 9,476,138 B2
(45) Date of Patent: Oct. 25, 2016

(54) COMPOSITE PLATING LIQUID

(75) Inventors: Yoriyuki Suwa, Nagano (JP); Kenji Kawamura, Nagano (JP); Syuzo Aoki, Nagano (JP); Masao Nakazawa, Nagano (JP); Susumu Arai, Nagano (JP)

(73) Assignees: SHINKO ELECTRIC INDUSTRIES CO., LTD, Nagano-Shi (JP); SHINSHU UNIVERSITY, Matsumoto-Shi (JP)

( * ) Notice: Subject to any disclaimer, the term of this patent is extended or adjusted under 35 U.S.C. 154(b) by 439 days.

(21) Appl. No.: 13/403,331

(22) Filed: Feb. 23, 2012

(65) Prior Publication Data

US 2012/0216997 A1 Aug. 30, 2012

(30) Foreign Application Priority Data

Feb. 24, 2011 (JP) ..... 2011-038171

(51) Int. Cl.

| | |
|---|---|
| ***F28F 13/18*** | (2006.01) |
| ***C25D 15/00*** | (2006.01) |
| ***C25D 3/02*** | (2006.01) |
| ***C25D 3/12*** | (2006.01) |
| *F28F 7/00* | (2006.01) |

(52) U.S. Cl.

CPC ..... *C25D 15/00* (2013.01); *C25D 3/02* (2013.01); *C25D 3/12* (2013.01)

(58) Field of Classification Search

CPC ..... C25D 15/00; C25D 3/00; C25D 3/02; C25D 3/12; C25D 9/02; C25D 9/04; F28F 13/18

USPC ..... 165/80.3, 185, 133; 361/704; 205/50, 205/109, 261; 428/408

See application file for complete search history.

(56) References Cited

U.S. PATENT DOCUMENTS

| | | | | |
|---|---|---|---|---|
| 2,208,657 | A * | 7/1940 | Ballay | 205/274 |
| 3,860,949 | A * | 1/1975 | Stoeckert et al. | 257/708 |
| 5,051,814 | A * | 9/1991 | Paal | 257/714 |
| 7,906,210 | B2 * | 3/2011 | Sato et al. | 428/408 |
| 2004/0069650 | A1 * | 4/2004 | Yoshimura et al. | 205/164 |
| 2007/0199826 | A1 * | 8/2007 | Son et al. | 205/238 |
| 2007/0221506 | A1 * | 9/2007 | Murakami | 205/261 |
| 2008/0008870 | A1 | 1/2008 | Sato et al. | |
| 2009/0224422 | A1 * | 9/2009 | Dubin | 264/259 |

FOREIGN PATENT DOCUMENTS

| | | |
|---|---|---|
| CN | 1563505 | 1/2005 |
| CN | 1725479 | 1/2006 |

(Continued)

OTHER PUBLICATIONS

Japanese Office Action with English translation dated Jul. 22, 2014, 9 pages.

(Continued)

*Primary Examiner* — Tho V Duong

(74) *Attorney, Agent, or Firm* — Rankin, Hill & Clark LLP

(57) ABSTRACT

In one embodiment, there is provided a composite plating liquid. The composite plating liquid includes: a plating metal salt; a sulfate of at least one element selected from alkali metals and alkaline earth metals; boric acid; a carbon nanotube; and a dispersant. Also, there is provided a plating method of plating a member using the composite plating liquid, and a composite plating film formed by the plating method.

5 Claims, 6 Drawing Sheets

(56) References Cited

FOREIGN PATENT DOCUMENTS

| | | | |
|---|---|---|---|
| JP | 62-109991 | | 5/1987 |
| JP | 04116191 A | * | 4/1992 |
| JP | 2005-089836 | | 4/2005 |
| JP | 2006-028636 | | 2/2006 |
| JP | 2006-28636 | | 2/2006 |
| JP | 2010222707 A | * | 10/2010 |

OTHER PUBLICATIONS

Chinese Office Action dated Apr. 3, 2015, Application No. 201210045704.1, English translation included, 14 pages.

Chinese Office Action with English Translation dated Sep. 21, 2015, 9 pages.

* cited by examiner

CROSS-SECTION SURFACE SEM IMAGES

RECESS BOTTOM

COMPARATIVE EXAMPLE 1

SIDE SURFACE

RECESS BOTTOM

EXAMPLE 1

SIDE SURFACE

SURFACE SEM IMAGES

EXAMPLE 1 (THICKNESS: 5 μm)

EXAMPLE 3

COMPOSITE PLATING LIQUID

This application claims priority from Japanese Patent Application No. 2011-038171, filed on Feb. 24, 2011, the entire contents of which are herein incorporated by reference.

BACKGROUND

1.Technical Field

Embodiments described herein relate to a composite plating liquid, a plated member and a heat radiation component.

2. Description of Related Art

With recent requirements such as size reduction and thinning on electronic apparatus, the tendency of sealing electronic apparatus closely is increasing, as a result of which the installation spaces of heat dissipation devices in electronic apparatus are being restricted increasingly. Therefore, it is strongly desired to develop a heat radiation component capable of radiating, quickly and more efficiently, heat generated by an electronic device provided inside an electronic apparatus.

A technique is known in which a metal plate is electroplated with a metal having high thermal conductivity to construct such a heat radiation component (see e.g., JP-A-2006-28636 and JP-A-2005-89836). What is called a composite plating film containing a carbon nano-material (e.g., carbon nanotubes or carbon nanofibers) which is a far superior heat radiation material is used as the metal. JP-A-2006-28636 and JP-A-2005-89836 describe that the heat radiation performance and the thermal conductivity of a composite plating film are enhanced by adding carbon nanotubes or the like. In view of recent requirements, it is desired to develop a heat radiation component having an even superior heat radiation characteristic.

The present inventors studied the above-described related art and have found that when a heat radiation component whose surface is formed with recesses and projections, for example, to optimize the surface area is electroplated with a composite plating liquid containing a carbon nano-material (e.g., carbon nanotubes or carbon nanofibers) the recess/projection surfaces are not sufficient in electrodeposition uniformity.

In particular, the inventors have found that the plating thickness is insufficient on the recess bottom surfaces and/or the side surfaces and there is large non-uniformity between those surfaces and the projection top surfaces.

The inventors studied enthusiastically on the basis of the above knowledge, and have found a particular composite plating liquid containing a carbon nano-material (e.g., carbon nanotubes or carbon nanofibers) and completed the invention. When electroplating is performed on a metal member having a surface that has a complex recess/projection shape using the above composite plating liquid, a metal plating film having a uniform thickness is formed across the complex recess/projection shape so as to contain a sufficient amount of carbon nano-material.

SUMMARY OF THE INVENTION

Exemplary embodiments of the present invention address the above disadvantages and other disadvantages not described above. However, the present invention is not required to overcome the disadvantages described above, and thus, an exemplary embodiment of the present invention may not overcome any disadvantages described above.

According to one or more illustrative aspects of the present invention, there is provided a composite plating liquid. The composite plating liquid includes: a plating metal salt; a sulfate of at least one element selected from alkali metals and alkaline earth metals; boric acid; a carbon nanotube; and a dispersant.

Other aspects and advantages of the present invention will be apparent from the following description, the drawings and the claims.

DETAILED DESCRIPTION OF EXEMPLARY EMBODIMENTS

Figure 1:
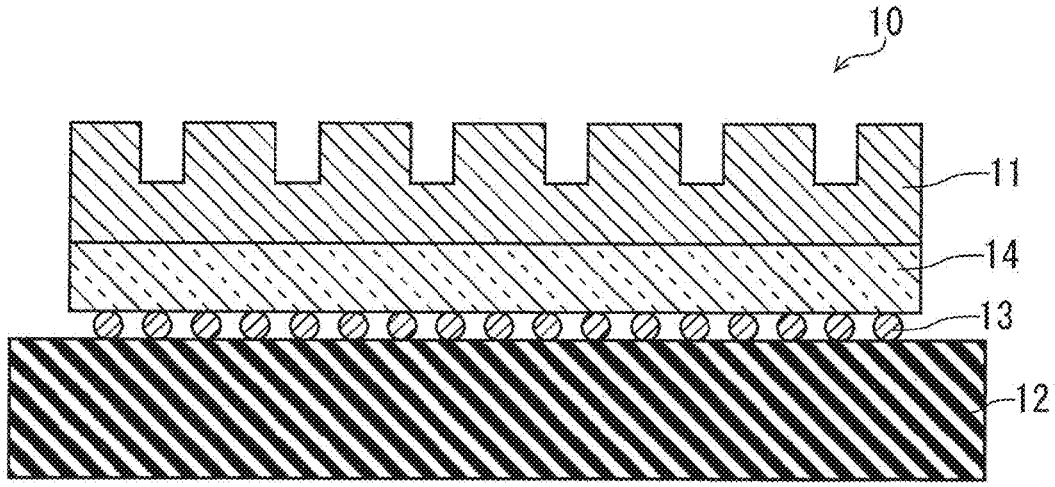
FIG. 1 schematically shows a semiconductor device having a heat radiation component (heat spreader) according to an embodiment of the present invention.

Hereinafter, exemplary embodiments of the present invention will be described with reference to the accompanying drawings. In all the drawings for the explanation of the embodiments, the members having the same functions are represented by the same reference numerals, and repeated description thereof will be omitted.

(Composite Plating Liquid)

The composite plating liquid according to the invention is a water-soluble composite plating liquid which contains a plating metal salt, a sulfate of at least one element selected from the alkali metals and the alkaline earth metals, boric acid, carbon nanotubes, and a dispersant.

The plating metal salt is a salt of a metal to be deposited using the plating liquid according to the invention. No particular limitations are imposed on the kind of the plating metal, and a proper metal can be selected according to the purpose of plating.

Specifically, for heat radiation of an electronic apparatus or an electronic device, for example, a metal having high thermal conductivity can be selected. Specific examples are metals such as nickel, silver, gold, cobalt, copper, and palladium or alloys of an iron-series metal and phosphorus and/or boron.

No particular limitations are imposed on the plating metal salt, and it may be any water-soluble salt of a metal used. Specific examples are a sulfate, a sulfamate, and a halide.

Where the metal is nickel, for example, preferable examples of the water-soluble metal salt are nickel sulfate, nickel bromide, nickel chloride, and nickel sulfamate. Halides are particularly preferable salts, and bromides are the best.

No particular limitations are imposed on the content of the plating metal salt. The usable concentration range is the same as in plating metal salts used conventionally, and can be 10 to 400 g/L. A preferable concentration range is 10 to 200 g/L, and 10 to 100 g/L is even preferable. Where the content of the plating metal salt is in this range, what is called scorching does not occur and, as described below, high electrodeposition uniformity can be attained.

The composite plating liquid according to the invention is a plating liquid further containing a sulfate of at least one element selected from the alkali metals and the alkaline earth metals. The sulfate(s) serves as what is called a conductive salt, for example. Specific examples are lithium sulfate, sodium sulfate, magnesium sulfate, potassium sulfate, sodium sulfamate, and potassium sulfamate. In the invention, the use of sodium sulfate or magnesium sulfate is preferable for the purpose of attaining high electrodeposition uniformity (see e.g., JP-A-62-109991).

No particular limitations are imposed on the content of the conductive salt. The usable concentration range is the same as that of conductive salts used in conventional plating liquids. In the invention, to attain high electrodeposition uniformity, it is preferable that the content (concentration) of the conductive salt be higher than in conventional plating liquids and be in a range of 150 to 800 g/L, for example. To attain even higher electrodeposition uniformity, it is preferable that the content of the conductive salt be in a range of 200 to 500 g/L. To attain even higher electrodeposition uniformity, it is preferable that the weight ratio between the plating metal salt and the conductive salt be in a range of 1:3 to 1:10.

One important feature of the composite plating liquid according to the invention is that it contains boric acid in addition to the above components. Boric acid serves as a buffer, for example. Therefore, no particular limitations are imposed on the content of boric acid except that the content should be such as to allow it to serve as a buffer effectively. The usable concentration range is 20 to 60 g/L, for example. To attain even higher electrodeposition uniformity, it is preferable that the weight ratio between the plating metal (e.g., nickel ions) and boric acid be in a range of 1:1 to 1:5.

Another important feature of the composite plating liquid according to the invention is that it contains carbon nanotubes. Carbon nanotubes are contained in a resulting metal plating film formed by electroplating. The inclusion of carbon nanotubes is the reason for the use of the term "composite."

In the invention, as described below, the term "carbon nanotube" is included in "carbon nano-particle" and means a fibrous carbon nano-particle that is 1 nm to 5 μm (preferably 10 to 500 nm) in thickness and 0.5 to 1,000 μm (preferably 1 to 100 μm) in length.

The term "fibrous carbon nano-particle" includes a carbon nanotube in a narrow sense, a carbon nanotube containing a particular substance such as a metal, a carbon nano-horn (a horn-shaped body whose thickness (diameter) increases continuously from one end to the other), a carbon nano-coil (coil-shaped curved body), a cup-stack carbon nanotube (a multilayered body of cup-shaped graphite sheets), a carbon nano-fiber, a carbon nano-wire (a carbon chain exists at the center of a carbon nanotube), etc.

In the invention, the carbon nanotube may be composed of either a single graphite layer (single-wall carbon nanotube) or multiple graphite layers (multi-wall carbon nanotube).

No particular limitations are imposed on how to acquire carbon nanotubes used in the invention. Carbon nanotubes can be synthesized by a conventional method (e.g., arc discharge method, laser ablation method, or CVD). It is also possible to use carbon nanotubes on the market as they are.

No particular limitations are imposed on the content of carbon nanotubes. The content of carbon nanotubes in a composite plating liquid can be set as appropriate taking into consideration a desired content of carbon nanotubes in a composite plating film. For example, the content of carbon nanotubes in a composite plating liquid can be set properly taking into consideration the size and shape of carbon nanotubes, whether they are of a single layer or multiple layers, the kinds and amounts of functional groups on the surface of each particle, and the kinds, amounts, etc. of other components.

The content of a water-based dispersant with respect to the total mass can be 0.0001 to 20 mass %, preferably 0.01 to 5 mass %. If the content is smaller than 0.0001 mass %, the water-based dispersant may exhibit insufficient characteristics. If the content is larger than 20 mass %, a problem of condensation or precipitation of carbon nanotubes may occur.

Where the plating metal is nickel, for example, to improve the heat radiation characteristic, it is desired that carbon nanotubes be contained at 0.1 to 10 wt % in a composite plating film.

Another important feature of the composite plating liquid according to the invention is use of a suitable dispersant. Since carbon nanotubes which are used in the invention are usually not wettable to water, it is preferable that they be dispersed in a water-soluble plating liquid using a dispersant. That is, since in many cases carbon nanotubes as described above are difficult to disperse sufficiently in a water-soluble plating liquid, it is preferable to use a dispersant to disperse them.

In the invention, no particular limitations are imposed on the kind of the dispersant. A proper one can be selected from known dispersants for carbon nano-materials. Example dispersants are anion surfactants, cation surfactants, non-ion surfactants, non-ion water-soluble organic polymers, amphoteric surfactants, amphoteric water-soluble organic polymers, various water-soluble organic polymer dispersants, organic polymer cations, and cyclodextrin.

In particular, the use of a water-soluble organic polymer dispersant is preferable. Specific examples are polyacrylic acid, a styrene-methacrylic acid copolymer, an alkyl ester acrylate-acrylic acid copolymer, a styrene-phenyl ester methacrylate-methacrylic acid copolymer, alginic acid, and hyaluronic acid.

In particular, the use of polyacrylic acid is preferable. No particular limitations are imposed on the degree of polymerization of polyacrylic acid. A proper degree of polymerization can be employed according to the kind and the amount of use of carbon nanotubes. An example molecular weight range of polyacrylic acid is 1,000 to 100,000.

The composite plating liquid according to the invention can further contain any of various additives when necessary. Examples additives are a pH adjusting agent such as nickel carbonate, a surfactant for pit prevention, and a brightening agent such as saccharin sodium.

No particular limitations are imposed on the manufacturing/preparing method of the composite plating liquid according to the invention. A composite plating liquid can be produced by mixing the above-described components together so that they have desired contents and dispersing carbon nanotubes using a stirrer or an ultrasonic apparatus if necessary. A composite plating liquid can be prepared before use and stored. It is also possible to prepare a composite plating liquid in using it. Where a composite plating liquid is prepared before use and stored, if necessary, the degree of dispersion of carbon nanotubes can be increased by stirring the plating liquid by a proper method before and/or during its use (electroplating).

No particular limitations are imposed on the methods for analyzing the components and their contents of the composite plating liquid according to the invention. It is preferable to use conventional analyzing methods. For example, the metal component can be analyzed using ordinary qualitative/quantitative analyzing methods for water-soluble metal ions as they are. Specific examples are general metal ion qualitative analyzing methods and quantitative analyzing methods such as ion chromatography and atomic absorption analysis. Carbon nanotubes (their kind, amount, etc.) can be analyzed by measuring an amount of carbon nanotubes by settling them out of a plating liquid or measuring shapes of carbon nanotubes using an electron microscope.

The dispersant (e.g., polyacrylic) acid can be analyzed qualitatively or quantitatively by separating it by column chromatography using a conventional absorption type, ion exchange type, or like filler and then performing any of various instrumental analyses (NMR, IR, UV-VIS, etc.).

(Composite Plating Method)

A composite plating method according to the invention is a method for plating a subject member in a composite manner using the above-described composite plating liquid according to the invention.

Plating subject members to which the composite plating method according to the invention can be applied are not restricted particularly in material, size, or shape. For example, where the composite plating method according to the invention employs nickel as a plating metal, it can be used for various plating subject members of conventional nickel plating.

In particular, the composite plating method according to the invention has a feature that even if the surface to be plated of a plating subject member has a complex recess/projection shape (in either microscopic or macroscopic scale), a plating film having a uniform, desired thickness can be formed so as to conform to such a shape. Plating films formed by the plating method according to the invention will be described below in more detail.

Specific example materials of plating subject members are various metals, metal alloys, resins, and composite materials of a resin and a non-resin. In particular, the plating method according to the invention can suitably be applied to metals and metal alloys. No particular limitations are imposed on the size of a plating subject material, and the plating method according to the invention can be used suitably by setting proper plating conditions (plating conditions will be described below) according to the size of a plating subject member.

The means of expression "the surface to be plated of a subject member has a complex recess/projection shape" includes not only cases that, for example, the surface of the plating subject member is not equidistant from an anode as a whole (i.e., macroscopically), is curved, or has a bent portion or a back surface but also a case that the surface of the plating subject member has a complex shape such as recesses and projections microscopically though it is equidistant from an anode macroscopically.

The term "complex shape such as recesses and projections" means a shape having differences in the distance from an anode (between a near portion and a far portion; e.g., between a projection top and a recess bottom) in a range of several micrometers to several millimeters. The aspect ratio of a recess/projection shape means the ratio of the depth of a recess to the size of its opening. A specific example plating subject member having such a surface shape is a heat radiation component (heat sink, heat spreader, or the like) of an electronic apparatus or an electronic device whose surface has a recess/projection shape (grooves, a lattice, or the like) to increase the surface area.

The plating method according to the invention can attain high electrodeposition uniformity across even a recess/projection shape having a large aspect ratio.

No particular limitations are imposed on the plating conditions of the plating method according to the invention. Plating conditions can be set easily by such conditions that are used in any of various conventional electroplating baths using a water-soluble plating liquid (e.g., Watts bath) as they are or with proper changes.

Specifically, the plating bath to be used for the plating method according to the invention is not restricted in size or shape. The size and shape of a plating bath can be determined properly according to the size and shape of a plating subject member, the size and shape of an anode, the amount of a plating liquid, and other factors. A proper atmosphere such as air or an inert gas can be used according to a purpose.

The anode to be used for the plating method according to the invention is not restricted particularly in type, size, or shape. As in conventional cases, a proper anode can be used according to the kind of a plating metal, a plating amount, a plating time, and other factors. In the case of nickel plating, an anode made of electrolytic nickel or the like can be used suitably.

Each of plating subject members described above can be used as a cathode in a usual manner. It is preferable that a cathode be held parallel with an anode in a plating bath.

No particular limitations are imposed on the temperature of the plating method according to the invention. The plating method according to the invention can be performed in temperature ranges of conventional metal electroplating methods (e.g., 10 to 90° C.). If necessary, the plating temperature can be varied as appropriate during plating.

No particular limitations are imposed on the pH range of the plating method according to the invention. The plating method according to the invention can be performed in pH ranges of conventional metal electroplating methods (e.g., pH 1 to 13). The pH may be either kept constant or varied as appropriate during plating. The pH may be set by properly selecting a dispersant used in the plating method according to the invention. Or a proper pH adjusting agent may be added for pH adjustment. Where the dispersant is polyacrylic acid, for example, an alkali salt of its part (e.g., sodium polyacrylate) can be used.

No particular limitations are imposed on the current density and the plating time of the plating method according to the invention. A proper current density and plating time can be employed according to the size and shape of a plating subject member, the components of a plating liquid, and desired plating quality (e.g., thickness of a plating film, leveling performance, and electrodeposition uniformity). The plating method according to the invention can be performed in a current density range of 0.1 to 10 $A/dm^2$, for example. To attain high electrodeposition uniformity, a range of 1 to 5 A/dm$^2$ is preferable.

(Composite Plating Film)

A composite plating film that is formed under the above-described conditions using the composite plating method according to the invention is a coat in which carbon nanotubes are buried in a desired metal plating film, and has the following features.

The thickness of a plating film can be set in a range of submicrometers to several millimeters. The thickness of a plating film is given high uniformity (electrodeposition uniformity) across a surface shape (including a complex recess/projection shape) of a plating subject member. The thickness can be selected properly according to the shape (in particular, length) of carbon nanotubes to be incorporated and/or a desired thickness of a plating metal.

For example, it is possible to determine a nickel metal layer thickness that is preferable in terms of thermal transmission and then properly determine a size and an amount of carbon nanotubes so that sufficient thermal transmission and heat radiation can be attained. In this manner, the thermal conduction and heat radiation efficiency can be optimized.

Various dimensions (in particular, length) of carbon nanotubes can be changed (e.g., shortened) by various conventional methods.

Features and a thickness of a composite plating film formed according to the invention and electrodeposition uniformity can easily be measured using an electron microscope, for example. This method enables observation of a surface and a cut surface of a composite plating film.

A kind and an amount of a metal contained in a plating film can be measured by an ordinary micron-level metal analyzing method (e.g., X-ray fluorescence analysis).

A kind and an amount of carbon nanotubes contained in a plating film by an ordinary micron-level element analyzing method (e.g., X-ray fluorescence analysis) or a method of dissolving a surface portion with acid, for example, to obtain a solution sample and performing element analysis on it by an ordinary method.

(Plated Member and Heat Radiation Component)

In the invention, the term "plated member" means a member at least part of whose surface is formed with a composite plating film according to the invention (described above). The term "heat radiation component" means a member which has a heat radiation or heat conduction function such as a heat spreader, a heat sink, a heat pipe, a vapor chamber, or a heat exchanger. A heat radiation component produced according to the invention is characterized in that at least part of its surface is formed with a composite plating film according to the invention. Therefore, a heat radiation component produced according to the invention is characterized in that at least part of its surface is formed with a plating film formed by electrodeposition that allows formation of a highly uniform coat both macroscopically and microscopically.

A plating subject member having a surface that has a complex shape (a microscopic recess/projection shape or a recess/projection shape having a large aspect ratio) to obtain a large surface area is formed with a metal coat at a uniform thickness across the complex shape by the plating method according to the invention, and the metal coat contains a sufficient amount of carbon nanotubes uniformly. With these features, a plated member produced can serve as a heat radiation component (e.g., heat sink) which exhibits far superior heat conductivity and high heat radiation efficiency when used in an electronic apparatus or an electronic device.

FIG. 1 shows a semiconductor device 10 having a heat spreader 11 (heat radiation component) according to an embodiment of the invention. The heat spreader 11 is provided so as to be in contact with an electronic device 14 that is mounted on a package (wiring board) 12 with joining members 13 interposed in between. While the semiconductor device 10 is in operation, heat is mainly generated by the electronic device 14. The heat generated by the electronic device 14 can be radiated to the external air efficiently and quickly by virtue of superior thermal conductivity and heat radiation performance of the heat spreader 11 according to the embodiment which is in contact with the electronic device 14.

Although the invention will be described below in a specific manner using Examples, the scope of the invention is not limited to the Examples.

EXAMPLES (1) Common Conditions of Electroplating:

Cathode: plating subject member made of copper (shapes will be described in the following Examples)

Anode: electrolytic nickel plate (50 mm×50 mm)

Plating temperature: 50° C.

Current density: 2 A/dm$^2$

Processing time: 25 min (2) Electron Microscope Measurement Conditions for Plating Film:

A surface was measured with a SEM at a magnification 2,000. A cross section of a plated coat was polished and cut and a resulting cut surface was measured with a SEM at a magnification 2,000.

(3) Measurement of Heat Radiation Characteristic:

A ceramic heater was attached to a prescribed copper block and a copper plate (measurement sample) was fixed to the copper block with an adhesive. A thermometer insertion hole was formed in the copper block, a thermometer was inserted into the hole, and a temperature was measured as a constant voltage was applied to the heater for 60 minutes.

Example 1

Figure 2:
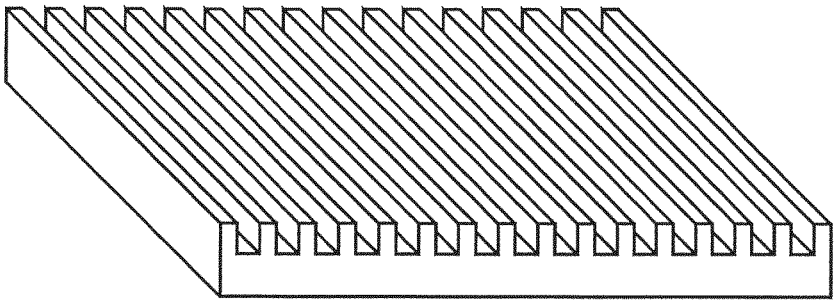
FIG. 2 schematically shows the shape of a heat radiation component used in Examples of the invention and Comparative Examples.

Manufacture of Plating Subject Member:

Grooves having a recess/projection shape shown in FIG. 2 (recess bottom width: 1.0 mm, wall height: 0.8 mm, projection top width: 2.0 mm) were formed by cutting in one surface of a square oxygen-free copper plate whose sides measured 16 to 49 mm and thickness was 1.27 to 3 mm The plate was rendered clean by degreasing. The surface area was 31.62 cm$^2$.

Preparation of Composite Electroplating Liquid:

While a solution composed of nickel bromide trihydrate (50 g/L), sodium sulfate (230 g/L), boric acid (40 g/L), and polyacrylic acid having a molecular weight 5,000 (dispersant; 0.1 g/L) was stirred, carbon nanotubes of 100 to 150 nm in diameter and 10 to 15 μm in length (2 g/L) were added and dispersed.

A resulting electroplating liquid (250 mL) was stored in a plating bath. While the electroplating liquid was stirred, plating was performed with the above-described anode plate opposed to the surface having the recess/projection shape of the above-described cathode plate. The plating liquid had pH 4.8.

A composite plating film (thickness: 10 μm) was observed with an electron microscope.

Figure 3:
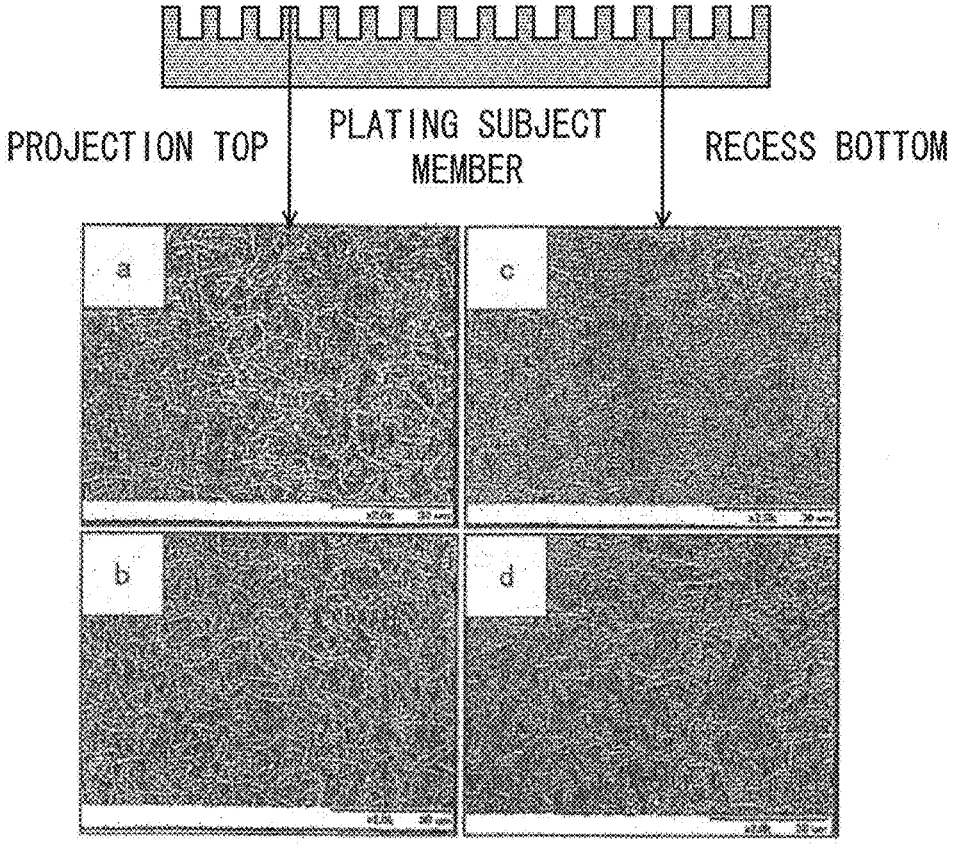
FIG. 3 is electron microscope images of projection tops and recess bottoms of composite plating films formed by Example 1 of the invention and Comparative Example 1 in which parts a and c are of Comparative Example 1 and parts b and d are of Example 1.
Figure 4A:
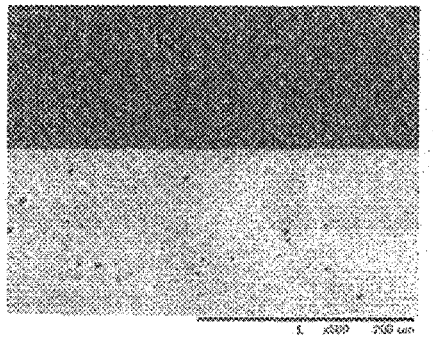
FIGS. 4A-4D are electron microscope images of cross-section surfaces of recess bottoms and side surfaces of composite plating films formed by Example 1 of the invention and Comparative Example 1, wherein FIGS. 4A and 4C correspond to a recess bottom and a side surface of Comparative Example 1, respectively, and FIGS. 4B and 4D correspond to a recess bottom and a side surface of Example 1, respectively.
Figure 4C:
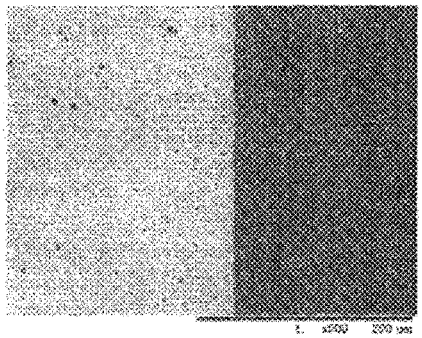
Figure 4B:
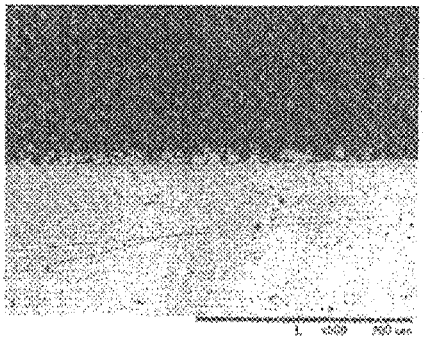
Figure 4D:
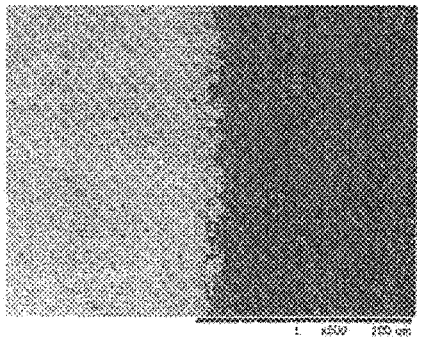

Electron Microscope Observation:

It is seen from parts b and d of FIG. 3 that at the projection tops a sufficient amount of metal nickel is deposited and a sufficient amount of carbon nanotubes exist (thickness: 10 μm). It is also seen that at the recess bottoms metal nickel is deposited by approximately the same amount as at the projection tops and a sufficient amount of carbon nanotubes exist (thickness: 10 μm). It is seen from FIG. 4D that on the side surfaces metal nickel is deposited by approximately the same amount as at the projection tops and the recess bottoms and a sufficient amount of carbon nanotubes exist (thickness: 10 μm).

These results indicate that the plating method of Example 1 can attain very high electrodeposition uniformity.

Figure 5:
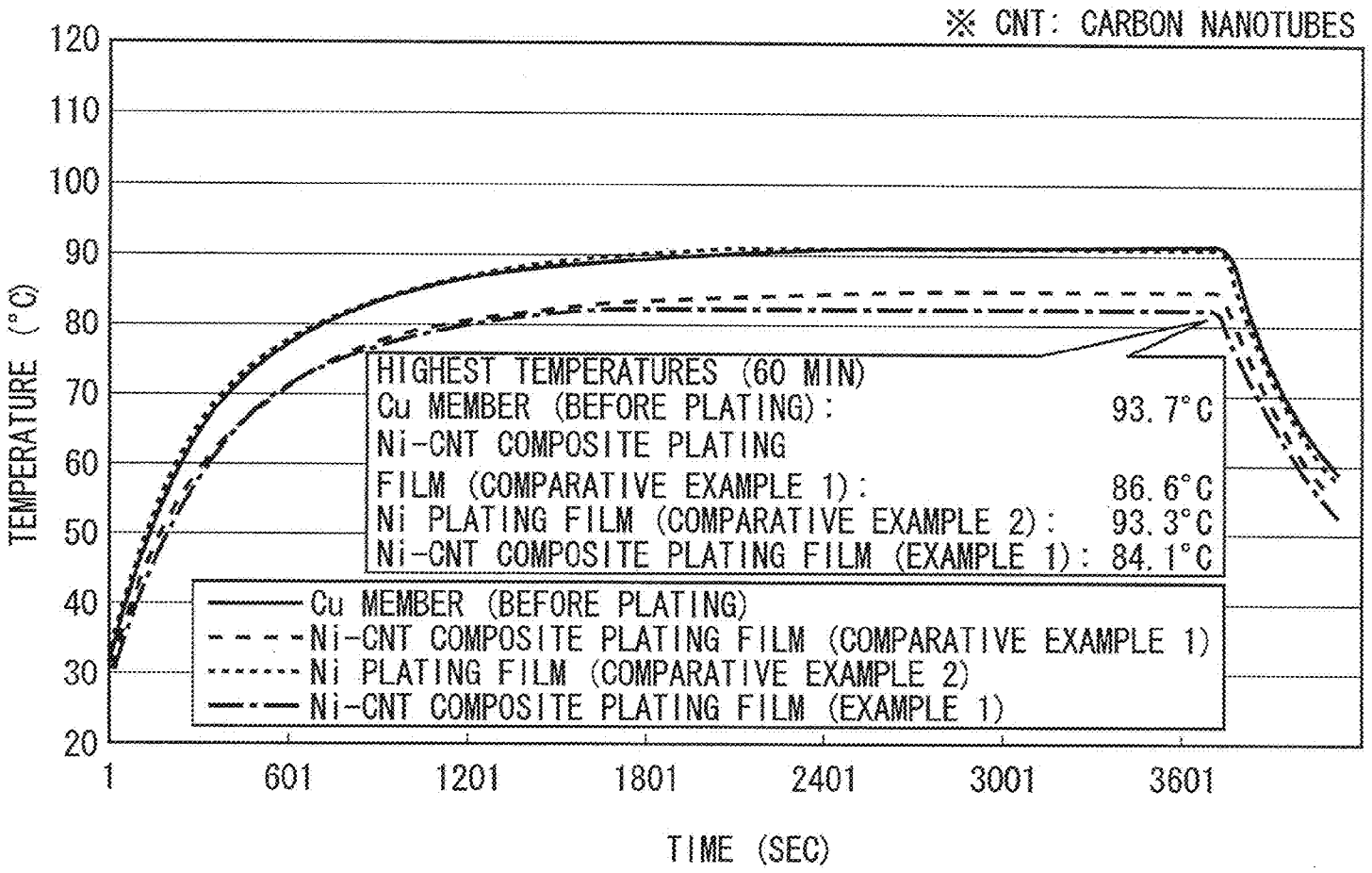
FIG. 5 is a graph showing heat radiation characteristics of composite plating films formed by Example 1 of the invention and Comparative Example 1.

Heat Radiation Characteristic Measurement:

It is seen from FIG. 5 that under the above-described measurement conditions the composite plating film of Example 1 exhibits a heat radiation characteristic that is lower by 2° C. than a heat radiation characteristic of a composite plating film of Comparative Example 1.

Comparative Example 1

Electroplating and electron microscope observation were conducted in the same manners as in Example 1 except that an electroplating liquid was prepared so as to have the following composition.

Preparation of Composite Electroplating Liquid:

While a solution composed of nickel sulfate hexahydrate (240 g/L), nickel chloride (45 g/L), boric acid (30 g/L), saccharin sodium (brightening agent; 2 g/L), 2-butyne-1,4-diol (brightening agent; 0.2 g/L), and polyacrylic acid having a molecular weight 5,000 (dispersant; 0.1 g/L) was stirred, carbon nanotubes of 100 to 150 nm in diameter and 10 to 15 μm in length (2 g/L) were added and dispersed.

Electron Microscope Observation:

It is seen from parts a and c of FIG. 3 that at the projection tops a sufficient amount of metal nickel is deposited and a sufficient amount of carbon nanotubes exist.

However, it is seen that at the recess bottoms almost no metal nickel is deposited and almost no carbon nanotubes exist. It is seen from FIG. 4C that on the side surfaces almost no metal nickel is deposited and almost no carbon nanotubes exist.

Example 2

Manufacture of Plating Subject Member:

Grooves having a recess/projection shape shown in FIG. 2 (recess bottom width: 0.5 mm, wall height: 0.8 mm, projection top width: 1.0 mm) were formed by cutting in one surface of a square oxygen-free copper plate whose sides measured 16 to 49 mm and thickness was 1.27 to 3 mm. The plate was rendered clean by degreasing. The surface area was 33.41 $cm^2$.

Electron Microscope Observation:

Electron microscope observation of a composite plating film formed showed that at the projection tops a sufficient amount of metal nickel was deposited and a sufficient amount of carbon nanotubes existed (thickness: 10 μm). It was also found that at the recess bottoms metal nickel was deposited by approximately the same amount as at the projection tops and a sufficient amount of carbon nanotubes existed (thickness: 10 μm). It was also found that on the side surfaces metal nickel was deposited by approximately the same amount as at the projection tops and the recess bottoms and a sufficient amount of carbon nanotubes existed (thickness: 10 μm). These results indicate that the plating method of Example 2 can attain very high electrodeposition uniformity, and that the plating method according to the invention makes it possible to form a composite plating film with high electrodeposition uniformity even in the case where a plating subject member has a recess/projection shape having a very large aspect ratio.

Example 3

Figure 6A:
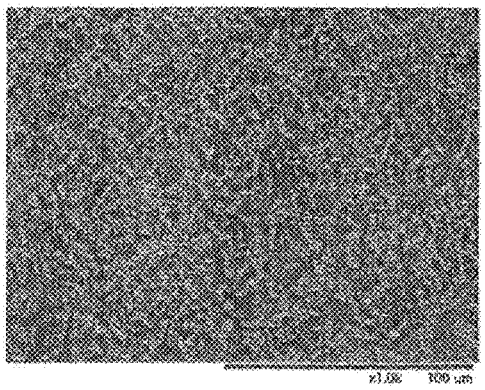
FIGS. 6A and 6B are surface electron microscope images of composite plating films formed by Examples 1 and 3 of the invention, respectively.
Figure 6B:
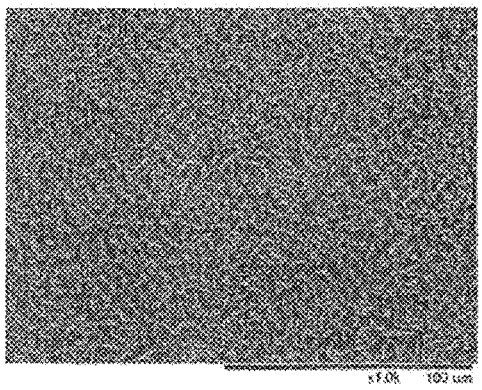

Electroplating was performed under the same conditions as in Example 1 except that smaller carbon nanotubes (diameter: 3 nm, length: 10 μm) produced by arc discharge machining were used, the thickness of a plating film was 5 μm, and the processing time was 12.5 minutes. FIG. 6B is an electron microscope image of a resulting plated surface. FIG. 6A is an electron microscope image for comparison of a plated surface of Example 1 (thickness: 5 μm). The electron microscope observation shows that at the projection tops a sufficient amount of metal nickel is deposited and a sufficient amount of carbon nanotubes exist (thickness: 5 μm). It was also found that at the recess bottoms metal nickel is deposited by approximately the same amount as at the projection tops and a sufficient amount of carbon nanotubes exist (thickness: 5 μm). It was also found that on the side surfaces metal nickel is deposited by approximately the same amount as at the projection tops and the recess bottoms and a sufficient amount of carbon nanotubes existed (thickness: 5 μm). These results indicate that a large amount of carbon nanotubes can be taken in even if a plating film is relatively thin because carbon nanotubes are smaller than in Example 1.

These results indicate that the plating method according to the invention makes it possible to form a composite plating film containing a desired amount of carbon nanotubes with very high electrodeposition uniformity by using carbon nanotubes having a proper size even in the case where a plating subject member has a recess/projection shape having a very large aspect ratio or a thin plating film is to be formed.

While the present invention has been shown and described with reference to certain exemplary embodiments thereof, other implementations are within the scope of the claims. It will be understood by those skilled in the art that various changes in form and details may be made therein without departing from the spirit and scope of the invention as defined by the appended claims.

What is claimed is:

1. A composite plating liquid comprising:

a plating metal salt including a halide salt, wherein the halide salt includes nickel bromide;

a sulfate of at least one element selected from alkali metals and alkaline earth metals;

boric acid;

carbon nanotubes; and a dispersant, wherein the dispersant is polyacrylic acid, wherein a metal of the plating metal salt comprises nickel, wherein a concentration of the plating metal salt is 10 to 100 g/L, and a concentration of the sulfate is 200 to 500 g/L, wherein a concentration of the carbon nanotubes is such that, when the composite plating liquid is made into a composite plating film by plating the composite plating liquid on a member, a weight percent of the carbon nanotubes in the composite plating film is 0.1 to 10 wt %, and wherein a weight ratio between a metal of the plating metal salt and the boric acid is in a range of 1:1 to 1:5.

2. A plating method comprising;

plating a member using the composite plating liquid according to claim 1.

3. A composite plating film formed by the method of claim 2, wherein the carbon nanotubes are provided in the composite plating film in the weight percent of 0.1 to 10 wt %.

4. A plated member comprising the composite plating film of claim 3.

5. A heat radiation component comprising:

a first surface having a plurality of grooves therein; and the composite plating film of claim 3, which is formed over an entire surface of the first surface, wherein a thickness of the composite plating film is substantially uniform over the first surface.

* * * * *